United States Patent [19]

Trost, Wayne C. et al.

[11] 4,031,922

[45] June 28, 1977

[54] VERTICALLY ARRANGED TRIAXIAL WEAVING MACHINE

[75] Inventors: Wayne C. Trost; Burns Darsie; Frank P. Trumpio, all of Rockford, Ill.

[73] Assignee: Barber-Colman Company, Rockford, Ill.

[22] Filed: Mar. 25, 1976

[21] Appl. No.: 670,341

[52] U.S. Cl. ..... 139/11; 139/18

[51] Int. Cl.[2] ..... D03D 41/00

[58] Field of Search ..... 139/11, 436, 13, 18, 139/100, DIG. 1, 16

[56] References Cited

UNITED STATES PATENTS

| | | | |
|---|---|---|---|
| 550,068 | 11/1895 | Crompton | 139/DIG. 1 |
| 1,184,790 | 5/1916 | Trautuetter | 139/DIG. 1 |
| 1,368,215 | 2/1921 | Stewart | 139/DIG. 1 |
| 2,679,264 | 5/1954 | Dunod | 139/13 |

FOREIGN PATENTS OR APPLICATIONS

| | | | |
|---|---|---|---|
| 327,099 | 3/1930 | United Kingdom | 139/13 |

*Primary Examiner*—Henry S. Jaudon
*Attorney, Agent, or Firm*—Bell, Seltzer, Park & Gibson

[57] ABSTRACT

A weaving machine for making triaxial fabrics in which a creel for supplying warp strands is mounted for rotation about a generally vertical axis in timed relation with interweaving of warp strands and wefts. In accordance with this invention, weaving instrumentalities for interweaving warp strands and wefts include a plurality of elongate heddles arranged in weftwise rows for guiding warp strands and means for moving the heddles and the warp strands guided thereby weftwise in timed relation with interweaving of warp strands and wefts.

5 Claims, 4 Drawing Figures

VERTICALLY ARRANGED TRIAXIAL WEAVING MACHINE

Triaxial fabrics and weaving machines for making such fabrics have been known for some time. Recent further developments of such fabrics and weaving machines, as exemplified by Dow U.S. Pat. No. Re28,155 and Doe et al. U.S. Pat. No. 3,799,209, has revived interest in such fabrics and weaving machines due to the desirable properties of such fabrics for certain uses. With revived interest and development of such weaving machines, consideration has been given to optimizing productivity of such machines and, in that connection, to increased weaving speeds, efficient use of floor space and facilitation of ready servicing.

In seeking such ends, it has been proposed that warp strands used in making triaxial fabrics be supplied to the weaving instrumentalities of a triaxial weaving machine from a creel supported for rotation about a vertical axis. Where such a structural organization is adopted for a triaxial weaving machine, it is necessary to provide structure for guiding warp strands issuing from the creel into an array of two sheets of generally parallel warp strands. Further, it is necessary that warp strands in each of the sheets be moved transversely of the sheets with the transverse direction of movement of warp strands in one of the sheets being opposite to that of warp strands and the other of the sheets. Such weftwise movement of warp strands assures interweaving of warp strands and wefts in the triaxial relationship described, for example, in Dow U.S. Pat. No. Re28,155 mentioned hereinabove.

As will be appreciated, positive control over the weftwise positioning and movement of warp strands is of significant importance in connection with the construction and operation of such a triaxial weaving machine. Accordingly, it is an object of the present invention to assure more positive control over warp strand guidance during triaxial weaving operations. In realizing this object of the present invention, a plurality of elongate heddles are arranged in weftwise rows for guiding warp strands and the heddles and warp strands guided thereby are moved weftwise in timed relation with the interweaving of warp strands and wefts. Such weftwise movement of heddles more positively assures accurate positioning of the warp strands guided thereby in the appropriate weftwise positions.

Yet a further object of the present invention is to accomplish the weaving of triaxial fabrics in accordance with a method in which weftwise movement of heddles along a row of heddles and transfer of heddles from one end of one row to an adjacent end of another row assures positive positioning of warp strands at the succession of locations required for triaxial fabric weaving.

Yet a further object of the present invention is to accomplish, in an improved triaxial weaving machine of the general type described, supporting and guiding engagement for heddles which in turn guide warp strands. In realizing this object of the present invention, heddles are positioned in at least two weftwise rows by stationary machine elements which support and guide the heddles in those rows during movement of the heddles both (a) longitudinally for forming the warp strands into warp sheds for insertion of wefts and (b) weftwise for forming the warp strands and inserted wefts into triaxial fabric constructions.

Some of the objects of the invention having been stated, other objects will appear as the description proceeds, when taken in connection with the accompanying drawings, in which FIG. 1 is an elevation view, partly schematic, of an improved triaxial weaving machine in accordance with this invention;

Figure 1:
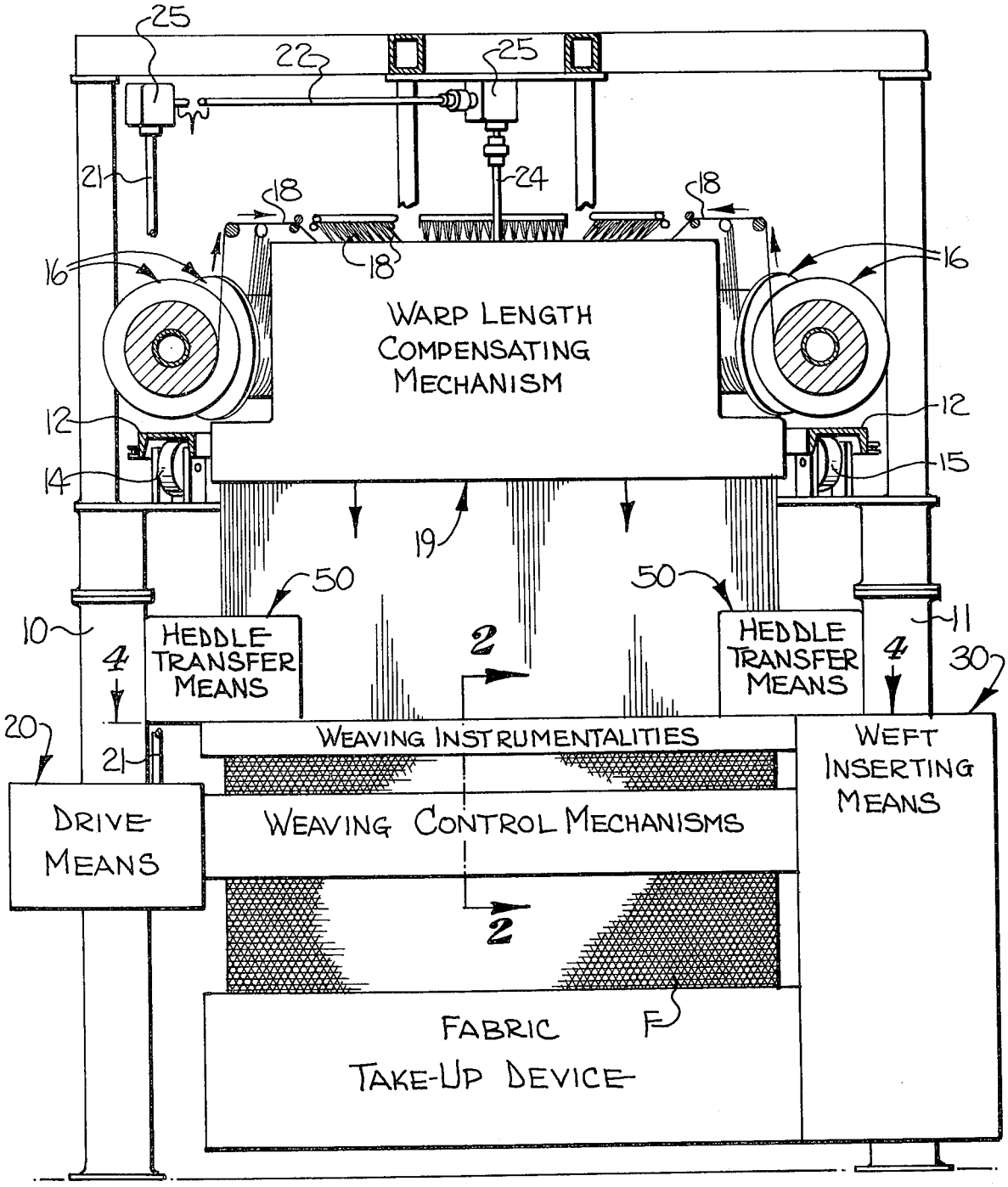

Referring now more particularly to the accompanying drawings, a triaxial weaving machine as there illustrated includes a plurality of upright standards (two of which are indicated at 10 and 11 in FIG. 1) which supports various operating mechanisms of the weaving machine. As will be made more clear hereinafter, certain of the operating mechanisms of the weaving machine may take forms which are the subject of other related patents and applications. However, it is contemplated that the triaxial weaving machine includes a creel means for supplying warp strands which is mounted for rotation about a generally vertical axis. In the form illustrated, such a creel means includes a ring member 12 supported by a plurality of supporting rollers (two of which are shown at 14, 15 In FIG. 1) which are in turn supported from the standards 10, 11 of the weaving machine. Mounted from the ring member 12 are a plurality of warp beams such as are generally indicated at 16, each of which supplies a plurality of warp strands for interweaving with wefts in forming triaxial fabrics. Warp strands 18 delivered from the beams 16 pass downwardly from the creel into an array of two generally parallel sheets of generally parallel warp yarns, with the guidance of the warp strands 18 into such an array preferably being accomplished by a warp length compensating mechanism generally indicated at 19 in FIG. 1. Such a generally vertical arrangement for a triaxial weaving machine and warp length compensating mechanism therefor are the subject matter of Halton et al. U.S. patent application Ser. No. 522,751, filed Nov. 11, 1974 for "Triaxial Fabric Forming Machine and Components Thereof"; Darsie et al. U.S. patent application Ser. No. 653,490 filed Jan. 29, 1976 for "Triaxial Weaving Machine With Warp Strand Guides"; and Townsend et al. U.S. patent application Ser. No. 653,371 filed Jan. 29, 1976 for "Triaxial Weaving Machine With Flexible Passageways for Guiding Warp strands." To the extent that the descriptions of such arrangements to be found in these copending U.S. patent applications are necessary for a clear understanding of the present invention, those descriptions are hereby incorporated by reference into this specification.

As is described more fully in the aforementioned applications, warp strands 18 which are arranged in two generally parallel sheets of generally parallel warp strands are moved, during interweaving with wefts, in a weftwise direction such that warp strands moving transversely in one of the sheets are moving in a direction opposite the direction of weftwise movement of warp strands in the other of the sheets. Rotation of the ring member 12 and such weftwise movement of warp strands 18 passing through the warp length compensating mechanism 19 are accomplished by interconnection of the ring member 12 and compensating mechanism 19 with drive means for the triaxial weaving machine. In the form illustrated, such interconnection with a drive means generally indicated at 20 is accomplished by an arrangement of shafts and angular drives including a vertical jack shaft 21, a horizontal jack shaft 22, a second vertical jack shaft 24 and suitable gear sets 25 operatively interconnected with the shafts.

In accordance with the present invention, the warp strands 28 arrayed in two sheets, pass downwardly to weaving instrumentalities (illustrated in block diagram formed of FIG. 1) which comprise a plurality of elongate heddles arranged in weftwise rows for guiding warp strands and means for manipulating the heddles as described more fully hereinafter. Preferably, the heddles may take the form of heddles as described in Kulczycki et al. U.S. patent application Ser. No. 582,246 filed May 30, 1975 now U.S. Pat. No. 3,985,160 "Heddle for a Weaving Machine for Making Triaxial Fabrics" or Kulczycki et al. U.S. patent application Ser. No. 597,290 filed July 18, 1975 now U.S. Patent No. 3,965,939 for "Heddle With Guide Means Thereon for Use in a Weaving Machine for Making Triaxial Fabrics." To the extent that the descriptions set forth in those applications are necessary for a full and clear understanding of the present invention, such descriptions are hereby incorporated by reference into the present specification.

As will be understood, each of the heddles 28 (FIGS. 2–4) is of an elongate strip material and has an elongate reduced width frontal portion terminating in a nose portion with a warp strand guide opening extending therethrough. Each heddle also has a rear portion which is broad relative to the frontal portion and is adapted to be engaged by means (to be described hereinafter more fully) for moving heddles and warp strands weftwise. As will be made more clear hereinafter, the relative widths of the frontal portion and rear portion accommodate supporting and guiding engagement of the heddle with other elements of the weaving machine while providing clearance for accommodating weftwise movement. Preferably, the heddles are moved weftwise in accordance with operations described in Kulczycki U.S. patent application Ser. No. 603,657 filed Aug. 11, 1975 for "Triaxial Weaving Machine with Heddle Shifting Means and Method." To the extent that the description there given is necessary for a full understanding of the present invention, such description is hereby incorporated by a reference into this specification.

More particularly, the means for supporting and guiding the heddles 28 preferably arranges the heddles in at least two rows. It will be understood that the weaving machine may include any desired number of weftwise rows of heddles, so long as at least one such row of heddles is provided to each side of the sheets of warp strands 18. As shown most clearly in FIG. 2, the illustrated weaving machine has four weftwise rows of heddles A, A′, B, B′. The upper rows A, A′ constitute a first set or pair of substantially opposing weftwise rows, and the lower rows B, B′ constitute a second set or pair of substantially opposing weftwise rows of heddles, with the two sets of heddles A, A′, B, B′ being disposed in warpwise spaced relation. More specifically, it will be observed that the lower pair of substantially opposing weftwise rows of heddles B, B′ are disposed more closely adjacent to or in the direction of the fell 29 of the triaxial fabric F being formed, or downstream of the other pair of weftwise rows of heddles A, A′.

Figure 2:
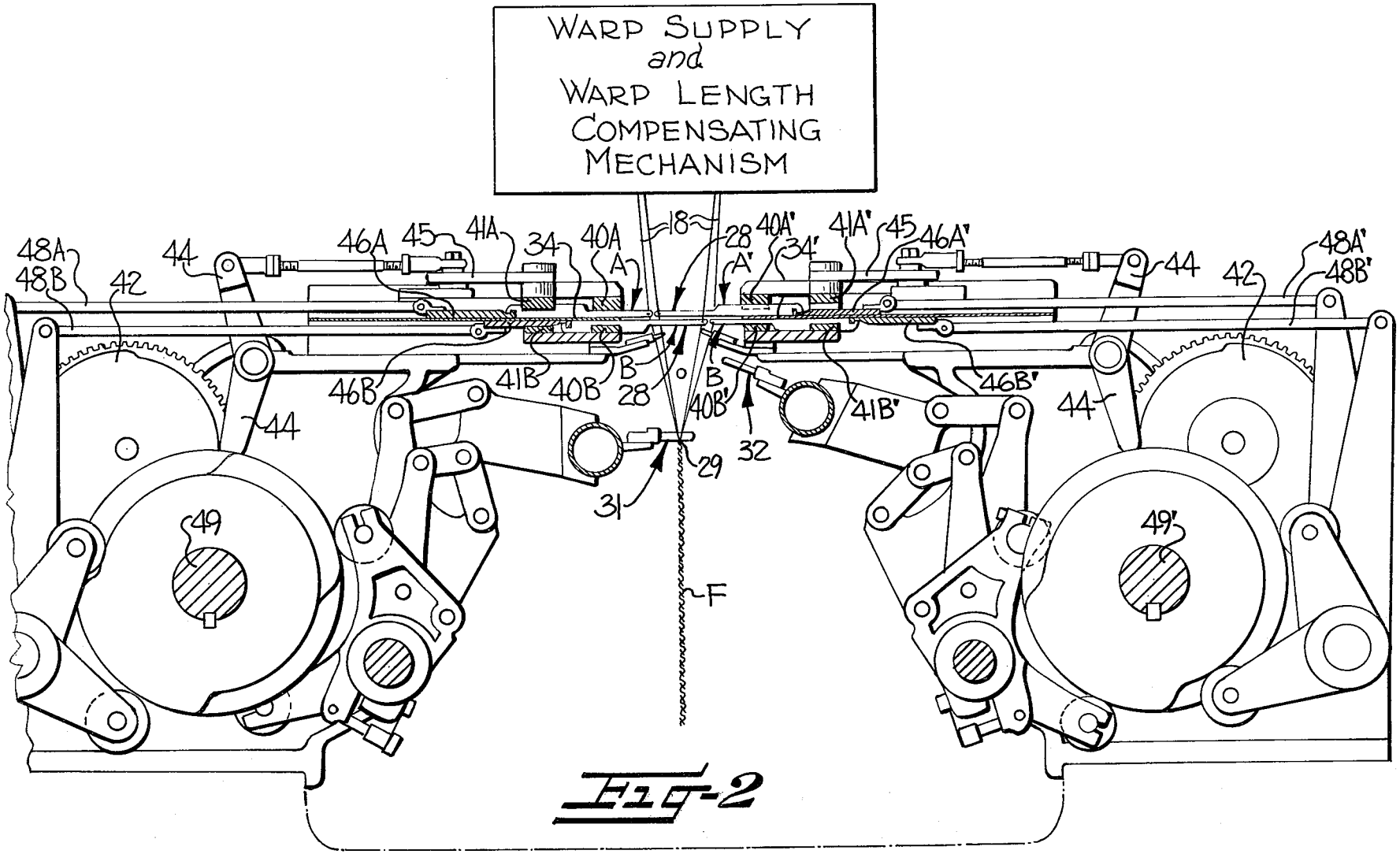
FIG. 2 is an elevation view, partly schematic and partly in section, through weaving instrumentalities and weaving control mechanisms of the weaving machine of FIG. 1, taken substantially along the line 2—2 in FIG. 1.

For purposes of this disclosure, the left-hand weftwise rows of heddles A, B in FIG. 2 will be referred to herein as the first rows in the respective first and second sets, and the right-hand weftwise rows of heddles A′, B′ will be referred to herein as the second rows in the respective first and second sets. It will be noted that both the first rows of heddles A, B are supported adjacent one side of the sheets of warp strands 18 and that both of the second rows of heddles A′, B′ are supported adjacent the other side of the sheets of warp strands. A weft inserting means (schematically illustrated in FIG. 1 at 30) enters warp sheds formed between the second rows of heddles A′, B′ and the fell 29 (FIG. 2) for interweaving wefts with the warp strands 18. Wefts inserted by the weft inserting means 30 are beaten against the fell by alternating beaters generally indicated at 31, 32. More specific description of a weft insertion means and beater mechanism suitable for the present invention may be found in Dow et al. U.S. Pat. No. 3,799,209. To the extent required for a clear understanding of the present invention, the description there found is hereby incorporated by reference into this specification.

Referring again to the heddles 28, the reduced width frontal portion may be about one-half as wide as the rear portion and terminates in a substantially rounded or substantially semicircular-shaped free end defining the front end of the respective heddle. Each heddle has a strand guide opening or eye therethrough closely adjacent the free front end thereof for guidingly engaging a respective warp strand 18. Thus, it will be observed in FIG. 2 that the warp strands 18 extend through respective heddles to the fell 29 of the triaxial fabric F being woven.

It is to be noted that opposite longitudinal side edges of a heddle 28 extend substantially parallel to each other and, since the elongate frontal portion has substantially less width than the rear portion, the medial portion of the heddle defines a projecting shoulder portion on the heddle. This shoulder portion is adapted to be engaged by a shifting bar of a heddle shifting means for shifting each respective row of heddles in unison weftwise during operation of the weaving machine. Each heddle also is provided with means adapted to be engaged for imparting longitudinal shedding movements, preferably in the form of a cutout partially defined by a hook-shaped projection at a rear end of the heddle remote from the frontal portion thereof.

Medial portions of the heddles 28, and particularly the shoulder portions thereof, are engaged by means which support and guide the heddles during longitudinal and weftwise movement. Further, such portions are engaged by means which effect the weftwise movement of heddles and the warp strands threadingly engaged in the guide opening or eye thereof. Such means are more fully described and shown in aforementioned Kulczycki U.S. patent application Ser. No. 603,657 filed Aug. 11, 1975, now U.S. Pat. No. 3,999,578 and the more complete description there given is hereby incorporated by reference into this specification to any extent necessary to obtain a full understanding of the present invention. Preferably, the means for supporting and guiding the heddles includes stationary guide plates 34, 34' disposed between the first and second rows of the respective first and second sets for slidable engagement with the adjacent longitudinal side edges of heddles 28 common to those rows. First passageway portions for guidingly receiving heddles of a corresponding row are provided by a plurality of elongate weftwise guide means or bars 40A, 40B, 40A', 40B', each suitably supported so that its surface opposing a corresponding guide plate 34, 34' is spaced from such guide plate a distance somewhat greater than the width of the reduced width frontal portions of the corresponding heddles. The surface of each bar adjacent a corresponding guide plate is in the form of a plurality of projecting separators or wall means defining a weftwise row of passageways for guiding respective heddles.

Spaced from the stationary guide members or bars are cooperating movable bars 41A, 41B, 41A', 41B', which similarly define passageway portions for guidingly receiving heddles. In operation, the movable bars engage medial portions of the heddles while the same are out of engagement with the passageways of the stationary bars and move the heddles weftwise. It will be understood that the reduced width of the frontal portion of the heddles is adapted to provide the clearance for accommodating such weftwise movement.

Figure 3:
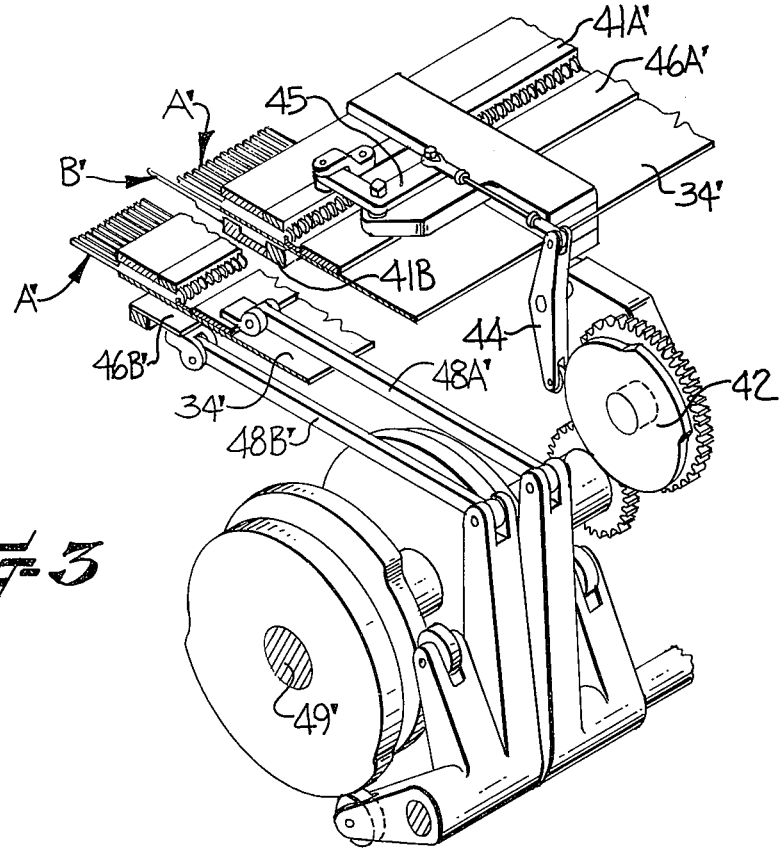
FIG. 3 is a perspective view, partly broken away, showing certain of the weaving instrumentalities and weaving control mechanisms of FIG. 2.
Figure 4:
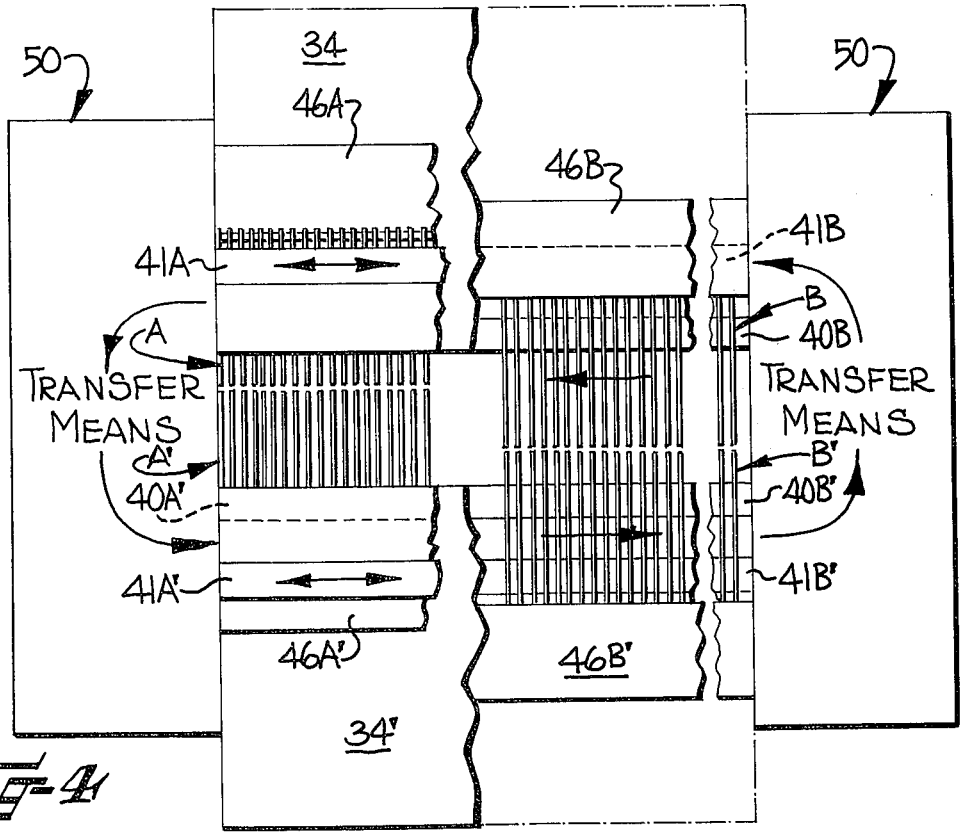
FIG. 4 is a plan view, partly schematic, of the weaving instrumentalities of the weaving machine of FIG. 1, taken substantially along the line 4—4 in FIG. 1.

More particularly, weaving control mechanisms (illustrated in block diagram form in FIG. 1) in the weaving machine of the present invention include shifting cams (one of which is illustrated in FIG. 3 at 42) which act through cam followers such as the cam follower 44 to oscillate bell crank members such as the member 45. With oscillation of the bell cranks, the movable bars such as the bar 41A' in FIG. 3 are oscillated weftwise in timed relation with other interweaving operations as described more fully hereinafter. Such weftwise movement shifts heddles from one passageway to another so as to accomplish the weftwise movement of heddles and warp strands described hereinabove.

Movement of the medial portions of the heddle 28 between the stationary passageways of the fixed bars 40A, 40B, 40A', 40B', and the passageways of the movable bars 41A, 41B, 41A', 41B' is accomplished by means which engages the cutout means of a plurality of heddles arranged in a common weftwise row for longitudinally moving the heddles to and from extended and retracted open-shed position to thereby form the warp strands guided by the heddles into warp sheds. The relative extended open-shed position and retracted open-shed position may be particularly noted from FIG. 2, wherein the heddles 28 of the second row A' of one set are in extended open-shed position while the heddles of the second row B' of the other set are in retracted open-shed position. In this connection, it will be noted that the heddles of the one set row A' have medial portions thereof engaged in the passageways of the corresponding fixed or stationary bar 40A', while the heddles of the other set row B' have medial portions thereof engaged in the movable passageways of the corresponding shifting bar 41B'. Thus, one shifting bar 41A' is free to return in an inactive stroke, while the other shifting bar 41B' is prepared for weftwise shifting, in unison, of all heddles common to the weftwise row received therein.

In order to impart longitudinal movement to the heddles 28, each heddle has cutout means therein, at an end remote from the reduced width frontal portion, adapted to be engaged for imparting longitudinal movement to the heddle. The weaving instrumentalities further comprise means for engaging the cutout means of a plurality of heddles common to a weftwise row for longitudinally moving the heddles between the extended and retracted open shed positions. While such heddle shedding arrangements are the subject matter of other and further patent protection, a description of such arrangement will be included here for purposes of completeness of the present description.

More particularly, each of the rows A, B, A', B' of heddles has a corresponding weftwise elongate ribbed bar means 46A, 46B, 46A', 46B' mounted for slidable movement adjacent one of the separator plates 34, 34'. By means of suitable links (two of which are shown at 48A', 48B' in FIG. 3), reciprocatory motion is transferred to the ribbed bar members from cam followers (FIGS. 2 and 3) driven by appropriately contoured cams on main drive cam shafts 49, 49'. The main drive cam shafts 49, 49' are driven in timed relation by the common drive 20 for the weaving machine, which additionally drives the weft insertion means, the creel and other elements of the weaving machine as described hereinabove. As will be recognized, cams 42 driving the heddle shifting motion and cams driving the motion of the beaters 31, 32 are also driven from the main cam shafts 49, 49' and thereby operate in timed relation with the other components of the weaving machine.

As will be appreciated, the heddle shedding motion and the heddle shifting motion cooperate for moving heddles 28 weftwise along the ribbed bar members and from one passageway to another, thereby moving warp strands 28 transversely in the two sheets. As indicated by arrows in FIG. 4, the direction of heddle and warp strand movement in one sheet is opposite to the direction of heddle and warp strand movement in the other sheet, thereby giving rise to the desired triaxial fabric construction.

As will be further appreciated, such movement of heddles and warp strands present successive heddles at a leading end of each of the rows A, B, A', B'. As such heddles are presented at the leading end of the weftwise rows, they are transferred by appropriate transfer means (indicated in block form generally at 50 in each of FIGS. 1 and 4). Such transfer means engagingly receive a heddle and move the same from one end of one weftwise row to an adjacent end of another weftwise row, thereby moving warp strands from one sheet to another sheet. It is contemplated that such heddle transfer means may take various specific forms and accordingly the heddle transfer means will not here be disclosed in significant detail. Such detail may be found in the description and illustrations of Kulczycki et al. U.S. patent application Ser. No. 603,756 filed Aug. 11, 1975 for "Triaxial Weaving Machine With Heddle Transfer and Method" and Townsend et al. U.S. patent application Ser. No. 620,332 filed Oct. 7, 1975 now U.S. Pat. No. 3,985,159 for "Improved Heddle Transfer Apparatus and Method for Triaxial Weaving Machine." To the extent that the structure illustrated and described in those applications is necessary for a full understanding of the present invention, such description is hereby incorporated by reference into the present specification.

As will be understood from FIGS. 1 and 2 of the drawings of this application, the weaving instrumentalities and control mechanisms described hereinabove are positioned beneath the rotating creel and the warp length compensating mechanism of a triaxial weaving machine. Such a generally vertical arrangement of instrumentalities provides a particularly advantageous arrangement in that weave room floor space is most efficiently used, while necessary access to the weaving instrumentalities for operation of the weaving machine is facilitated.

In the drawings and specification, there has been set forth a preferred embodiment of the invention, and although specific terms are employed, they are used in a generic and descriptive sense only and not for purposes of limitation.

That which is claimed is:

1. A weaving machine for making triaxial fabrics comprising creel means for supplying warp strands and mounted for rotation about a generally vertical axis, a plurality of elongate heddles arranged in weftwise rows spaced vertically from said creel means for guiding warp strands supplied from said creel means, means engaging warp strands intermediate said creel means and said heddles for guiding warp strands into an array of two generally parallel sheets of generally parallel warp yarns, means for moving said heddles longitudinally to form the warp strands into warp sheds and for moving said heddles and the warp strands guided thereby weftwise during weaving in timed relation with rotation of said creel means, and means for transferring said heddles from one end of one weftwise row to an adjacent end of another weftwise row.

2. A weaving machine according to claim 1 further comprising common drive means operatively connected for supplying motive power to said creel means, said heddle moving means and said heddle transfer means.

3. A weaving machine for making triaxial fabrics comprising creel means including a plurality of beams for supplying warp strands, said beams being mounted in a generally circular array about a generally vertical axis and said creel means being mounted for rotation about said axis, a plurality of elongate heddles arranged in weftwise rows below said creel means for guiding warp strands supplied from said beams, means engaging warp strands intermediate said creel means and said heddles for guiding warp strands into an array of two generally parallel sheets of generally parallel warp yarns, means for moving said heddles longitudinally to form the warp strands into warp sheds and for moving said heddles and the warp strands guided thereby weftwise during weaving in timed relation with rotation of said creel means, and means for transferring said heddles from one end of one weftwise row to an adjacent end of another weftwise row.

4. A weaving machine according to claim 3 further comprising common drive means operatively connected for supplying motive power to said creel means, said heddle moving means and said heddle transfer means.

5. A weaving machine for making triaxial fabrics comprising creel means for supplying warp strands and mounted for rotation about a generally vertical axis, a plurality of elongate heddles arranged in pairs of substantially opposing weftwise rows below said creel means for guiding warp strands supplied from said creel means, means engaging warp strands intermediate said creel means and said heddles for guiding warp strands into an array of two generally parallel sheets of generally parallel warp yarns, means for moving said heddles longitudinally to form the warp strands into warp sheds and for moving said heddles and the warp strands guided thereby weftwise during weaving in timed relation with rotation of said creel means, and means for transferring said heddles from one end of a pair of weftwise rows to an adjacent end of the other, opposing row thereof.

* * * * *

UNITED STATES PATENT AND TRADEMARK OFFICE

CERTIFICATE OF CORRECTION

PATENT NO. : 4,031,922

DATED : June 28, 1977

INVENTOR(S) : Wayne C. Trost, Burns Darsie and Frank P. Trumpio

It is certified that error appears in the above-identified patent and that said Letters Patent are hereby corrected as shown below:

Column 2, Line 33, "In" should be --in--.

Column 3, Line 14, "28" should be --18--.

Column 3, Line 23, after "3,985,160" insert --for--.

Column 5, Line 4, delete "the".

Column 6, Line 32, "28" should be --18--.

Column 8, Line 34, after "of", first occurrence, insert --one of a--.

Signed and Sealed this

*Twentieth* Day of *September 1977*

[SEAL]

*Attest:*

RUTH C. MASON
*Attesting Officer*

LUTRELLE F. PARKER
*Acting Commissioner of Patents and Trademarks*